United States Patent [19]

Mears

[11] Patent Number: 4,570,371

[45] Date of Patent: Feb. 18, 1986

[54] RAPID LOADER DEVICE

[75] Inventor: Lawrence N. Mears, Niles, Ohio

[73] Assignee: Center Line Industries, Inc., Warren, Ohio

[21] Appl. No.: 658,660

[22] Filed: Oct. 9, 1984

[51] Int. Cl.[4] ..... F41C 27/00; F42B 39/06

[52] U.S. Cl. ..... 42/90; 42/87

[58] Field of Search ..... 42/90, 87

[56] References Cited

U.S. PATENT DOCUMENTS 1,786,537 12/1930 Holek ..... 42/87
2,403,012 7/1946 McPheters ..... 42/87
2,451,521 10/1948 Uglum ..... 42/87

FOREIGN PATENT DOCUMENTS 304379 2/1921 Fed. Rep. of Germany ..... 42/90
555367 8/1943 United Kingdom ..... 42/90

*Primary Examiner*—Charles T. Jordan
*Attorney, Agent, or Firm*—Harpman & Harpman

[57] ABSTRACT

A rapid loader device for use with cartridge retaining magazines in automatic and semi-automatic firearms or the like. The rapid loader device engages each cartridge and forces the same into the magazine with an offset lever action.

2 Claims, 4 Drawing Figures

RAPID LOADER DEVICE

BACKGROUND OF THE INVENTION

1. Technical Field

This invention relates to devices used to reload magazines for self-loading firearms that require that each cartridge be forced into the magazine one at a time.

2. Description of the Prior Art

Prior devices of this type have relied on a variety of different ways of rapid loading cartridges into magazines. See for example U.S. Pat. Nos. 1,786,537, 2,403,012, and 2,451,521.

In U.S. Pat. No. 1,786,537, a device is shown having an enclosure holding a number of cartridges that drop down for engagement with a lever and a feed arm forcing a plurality of cartridges into the magazine at one time.

In U.S. Pat. No. 2,403,012, a magazine loader is disclosed in which a plurality of shells are stacked vertically in a loader which in turn forces the shells in a row into the magazine by exerting pressure on a thumb piece and guard.

In U.S. Pat. No. 2,451,521, a magazine loader is shown having a vertical raceway holding a number of prepositioned cartridges which are dispensed by a plunger into the weapon magazine.

Applicant's device utilizes a cartridge engagement lever which is positioned adjacent the loading end of a magazine that repeatedly engages single cartridges positioned on the top of the magazine forcing the same downward within the magazine.

SUMMARY OF THE INVENTION

A rapid loading device for loading magazines of self-loading firearms. The device is temporarily positioned adjacent the magazines opening so that as a cartridge is placed atop the magazine, a loading lever pushes each cartridge downwardly into the magazine. The loading lever is supported on the magazine by a friction engagement clamp adjacent the top of the magazine.

DESCRIPTION OF THE PREFERRED EMBODIMENT

A rapid loader device for loading cartridges into magazines of self-loading automatic or semi-automatic firearms comprises a generally rectangular clamping support bracket 10 having a pair of spaced outwardly extending oppositely disposed inturned flanges 11 and 12 defining a lever support portion 13 on one end of said clamping support bracket 10. A pair of spaced apertured tabs 14 and 15 extend from the opposite end of said clamping support bracket 10 with the tabs being offset from the center line of the longitudinal axis of the bracket 10.

Figure 1:
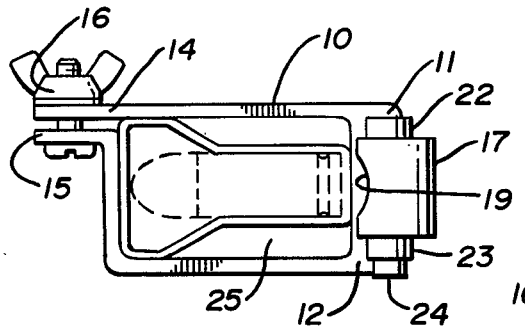
FIG. 1 is a top plan view of the rapid loader device.
Figure 3:
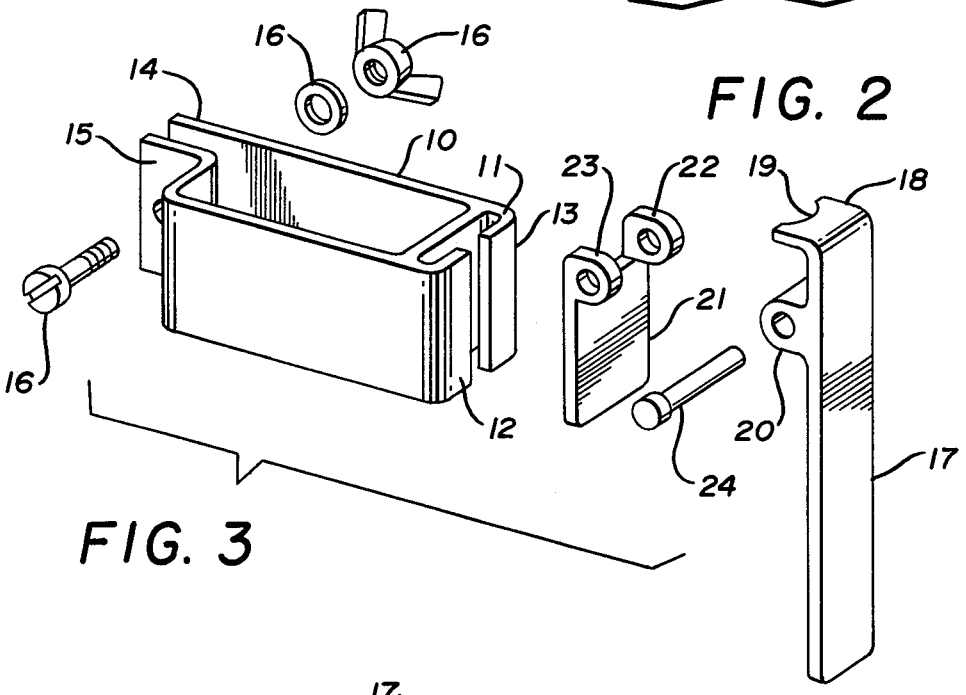
FIG. 3 is an exploded perspective view of the rapid loader device.

An adjustable threaded fastener assembly 16 is positioned through the apertured tabs 14 and 15 as best seen in FIGS. 1 and 3 of the drawings securing the same together. A loading lever 17 has a right angular disposed end portion 18 with a recessed curved end edge 19 thereon. An apertured lug 20 is integrally formed on the loading lever 17 in spaced relation to said angularly disposed end portion 18.

Figure 2:
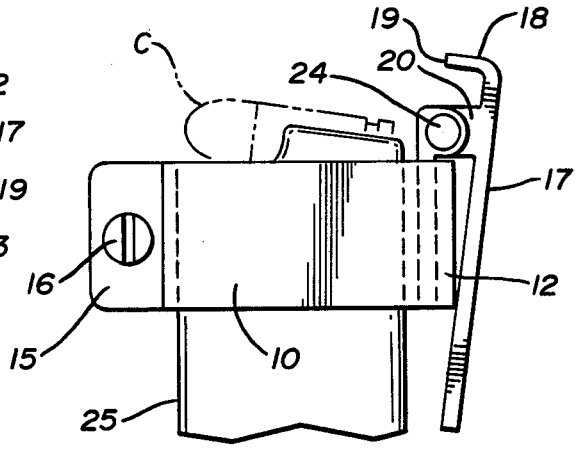
FIG. 2 is a side elevation of the rapid loader device on a magazine with a portion broken away.
Figure 4:
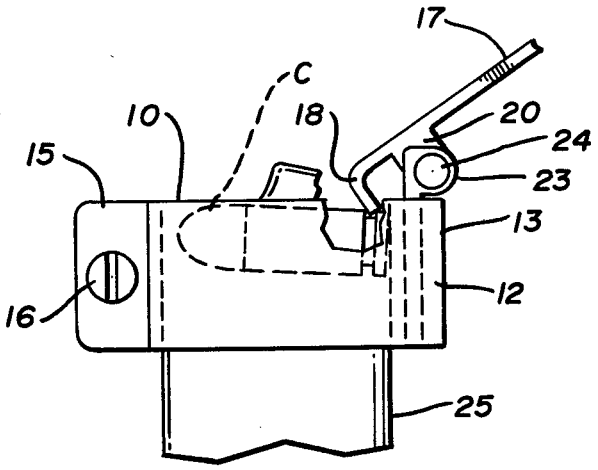
FIG. 4 is a side elevation of the rapid loader device with a cartridge positioned within the magazine.

A pivot bracket 21 has a generally flat rectangular configuration with a pair of spaced oppositely disposed apertured bosses 22 and 23 on one end thereof. A pivot pin 24 supports and secures in pivoting relation the apertured lug 20 of the loading lever 17 in registration between said apertured bosses 22 and 23 by extending therebetween as best seen in FIG. 1 of the drawings. The pivot bracket 21 is positioned within the opening defined by the inturned flanges 11 and 12 in the lever support portion 13 of the clamping support bracket 10 with the bosses 22 and 23 extending thereabove as best seen in FIGS. 2 and 4 of the drawings.

In use, the rapid loader device is clamped on the upper end of a spring loaded cartridge magazine 25 of a self-loading automatic or semi-automatic firearm by compression of the apertured tabs 15 and 16 held together by the fastener assembly 16, as will be understood by those skilled in the art. The user places a cartridge C shown in broken lines on the top of the magazine 25 as seen in FIG. 2 of the drawings. The user then moves the loading lever 17 engaging the curved end edge 19 of the loading lever 17 against the cartridge C as seen in FIG. 4 of the drawings forcing the cartridge C downwardly into the magazine 25. The above described action is repeated until the magazine 25 is full and ready for loading into the firearm as will be well understood by those skilled in the art.

With the utilization of this device, greater speed and more importantly less fatigue will occur when loading a number of larger magazines which require greater strength as the number of cartridges retained in the magazine increases.

It will thus be seen that a new and useful rapid loader device has been illustrated and described and it will be apparent to one skilled in the art that various and changes and modifications may be made therein without departing from the spirit of the invention and having thus described my invention.

What I claim is:

1. A rapid loader device for a firearm magazine comprising a clamping support bracket engagable on said magazine, a loading lever having a right angularly disposed end portion and means for removably attaching said loading lever to said clamping support bracket, said right angularly disposed end portion being spaced in relation to said clamping support bracket, means for securing said clamping support bracket to said magazine, said means for securing said clamping support bracket to said magazine comprising a pair of spaced apertured tabs extending from said clamping support bracket and a fastener assembly engaging said apertured tabs for moving said apertured tabs toward one another.

2. The rapid loader device of claim 1 wherein said means for removably attaching said loading lever to said clamping support bracket consists of a pivot bracket and a pair of spaced oppositely disposed inturned flanges on said clamping support bracket defining a pocket into which said pivot bracket is positioned.

* * * * *